US011306744B2

(12) United States Patent
Ahmed

(10) Patent No.: US 11,306,744 B2
(45) Date of Patent: Apr. 19, 2022

(54) AIR LIFT PUMP

(71) Applicant: University of Guelph, Guelph (CA)

(72) Inventor: Wael Ahmed, Guelph (CA)

(73) Assignee: UNIVERSITY OF GUELPH, Guelph (CA)

( * ) Notice: Subject to any disclaimer, the term of this patent is extended or adjusted under 35 U.S.C. 154(b) by 0 days.

(21) Appl. No.: 17/278,441

(22) PCT Filed: Oct. 9, 2019

(86) PCT No.: PCT/CA2019/051437

§ 371 (c)(1),
(2) Date: Mar. 22, 2021

(87) PCT Pub. No.: WO2020/073122

PCT Pub. Date: Apr. 16, 2020

(65) Prior Publication Data

US 2021/0355967 A1 Nov. 18, 2021

Related U.S. Application Data

(60) Provisional application No. 62/743,016, filed on Oct. 9, 2018.

(51) Int. Cl.
*F04F 5/24* (2006.01)
*F04F 1/20* (2006.01)

(52) U.S. Cl.
CPC ..... *F04F 5/24* (2013.01); *F04F 1/20* (2013.01)

(58) Field of Classification Search
CPC ..... F04F 5/24; F04F 1/20; F04F 5/26; F04F 5/14; F04F 5/36; F04F 5/42; F04F 5/44; F04F 5/463; F04F 5/46
See application file for complete search history.

(56) References Cited

U.S. PATENT DOCUMENTS 5,382,137 A 1/1995 Lane
8,596,989 B2 12/2013 Badr et al.
(Continued)

FOREIGN PATENT DOCUMENTS

CN 108980121 * 12/2018 ..... F04F 5/24
FR 3085282 * 3/2020 ..... F04F 5/12
WO 2000061948 10/2000

OTHER PUBLICATIONS

Int'l Search Report for PCT/CA2019/051437, dated Dec. 13, 2019.

*Primary Examiner* — Bryan M Lettman
(74) *Attorney, Agent, or Firm* — Blue Filament Law PLLC

(57) ABSTRACT

A pump comprises: a vertically-extending conduit having an intermediate portion extending between lower and upper portions, the intermediate portion having a cross-sectional area smaller than that of the upper portions, a lift arrangement including an array of ports arranged over a length of the lower portion, each port of the array having a terminus at the lower portion and extending horizontally away from the terminus such that the working fluid is directed towards a center of the conduit; and an injector having a terminus at the top of the intermediate portion and extending vertically downwardly such that the working fluid is directed vertically upwardly, the terminus of the injector being defined by a cylindrical groove, an annular chamber surrounding the injector, having a length and communicating with the injector through a row of apertures spaced a distance from the junction of the transition portion and the intermediate portion.

4 Claims, 3 Drawing Sheets

(56) References Cited

U.S. PATENT DOCUMENTS

| | | | | |
|---|---|---|---|---|
| 10,392,775 | B2 * | 8/2019 | Smith | E02F 3/9243 |
| 2012/0308407 | A1 * | 12/2012 | Badr | F04F 1/06<br>417/118 |
| 2014/0356194 | A1 * | 12/2014 | Ahmed | F04F 1/18<br>417/65 |
| 2017/0102010 | A1 | 4/2017 | Cheong | |

* cited by examiner

AIR LIFT PUMP

FIELD OF THE INVENTION

The invention relates to the field of airlift pumps.

BACKGROUND OF THE INVENTION

It is well-known to move fluidic material [liquids or solid-liquid mixtures] through a vertical pipe, partially immersed in the material, by introducing compressed air at a lower part of the pipe.

SUMMARY OF THE INVENTION

Forming one aspect of the invention is as pump for use with a supply of working fluid and a supply of fluidic material having a density higher than that of the working fluid, the pump comprising a vertically-extending conduit and a lift arrangement.

The vertically-extending conduit, in use, is immersed in the supply of fluidic material, the vertically-extending conduit having a lower portion, an upper portion and an intermediate portion between the lower and upper portions, the intermediate portion having a cross-sectional area smaller than that of the upper portions, the lower portion having a diameter D and the intermediate portion having a diameter d.

The lift arrangement includes an array of N2 ports, an injector and an annular injector.

The array is arranged over a length of the lower portion, each port of the array having a diameter E, further having a terminus at the lower portion and extending horizontally away from the terminus such that the working fluid is directed towards a center of the conduit.

The injector has a terminus at the top of the intermediate portion and extending vertically downwardly such that the working fluid is directed vertically upwardly, the terminus of the injector being defined by a cylindrical groove having a thickness B.

The annular chamber surrounding the injector, having a length A and communicating with the injector through a row of N1 apertures spaced a distance F from the junction of the transition portion and the intermediate portion and each having a diameter C.

If B, C, D, E and F are expressed in millimetres:

D is between about 25.4 and 203.2

$B \approx 0.521(D)^{0.296}$ $C \approx 1.918(D)^{0.343}$ $E \approx 0.521(D)^{0.296}$ $F \approx 0.321D - 3.41$ According to another aspect of the invention, D, A, B, C, d, E, F, N1 and N2 can be sized according to any one of the following geometries:

| Geometry | D mm | A mm | B mm | C mm | d mm | E mm | F mm | N1 | N2 |
|---|---|---|---|---|---|---|---|---|---|
| 1 | 25.4 | 20.32 | 1.5 | 15.24 | 15.24 | 1.5 | 6.35 | 12 | 108 |
| 2 | 50.8 | 22.098 | 1.5 | 38.1 | 38.1 | 1.5 | 8.128 | 12 | 378 |
| 3 | 101.6 | 68.072 | 2 | 90.2 | 90.2 | 2 | 34.036 | 10 | 038 |
| 4 | 152.4 | 101.6 | 2 | 147.1 | 147.1 | 2 | 44.45 | 15 | 1480 |
| 5 | 203.2 | 142.21 | 3 | 12.7 | 194.2 | 3 | 61.15 | 14 | 1280 |

According to another aspect of the invention, the pump can be used with air as the working fluid and water as the fluidic material.

According to another aspect of the invention, in use, the combination of air flow, water flow and geometry can fall substantially in accordance with any of the following combinations:

| Combination | Air Flow ($m^3$/S) | Water Flow ($m^3$/S) |
|---|---|---|
| 1 | .00023-.00027 | .0002-.004 |
| 2 | .0002-.0018 | .0005-.0007 |
| 3 | .00115-.01 | .0025-.0037 |
| 4 | .006-.025 | .006-.017 |
| 5 | .008-.05 | .011-.015 |

Advantages, features and characteristics of the invention will become apparent upon a review of the following detailed description and the appended drawings, the latter being briefly described hereinafter.

DETAILED DESCRIPTION

Figure 1:
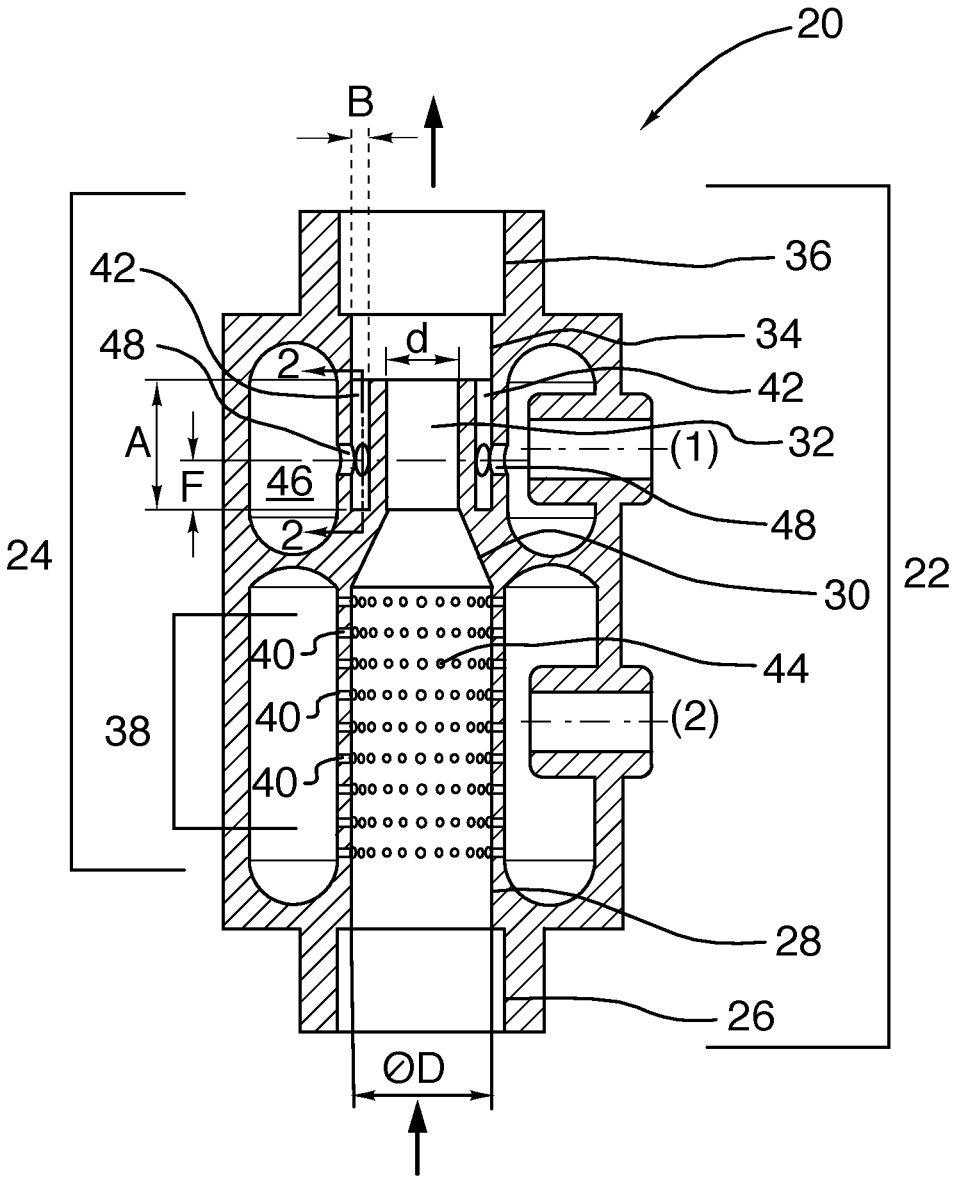
FIG. 1 is a cross-section of a pump constructed according to an exemplary embodiment of the invention.
Figure 2:
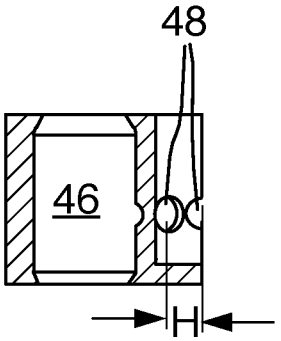
FIG. 2 is a section along L-L of FIG. 1.

A pump 20 according to an exemplary embodiment of the invention is shown in FIG. 1 and FIG. 2.

The pump 20 will be understood to be of the type for use with a supply of working fluid and a supply of fluidic material having a density higher than that of the working fluid, neither shown, and will be seen to comprise an annular conduit 22 and a lift arrangement 24.

The conduit 22, in use, is vertically-extending and has: a round inlet 26; a cylindrical lower portion 28 communicating with and having a diameter D smaller than the inlet; a frustoconical transition portion 30 communicating with the lower portion and tapering as it extends therefrom at an angle; intermediate portion 32 communicating with the transition portion 30 and having a diameter d; a bridging portion 34 communicating with and having a larger diameter than the intermediate portion 32; and an upper portion 36.

The diameters of the inlet 26 and upper portion 36 will be understood to be sized to receive conventional pipe having an inside diameter D, not shown.

The lift arrangement 24 includes an array 38 of ports 40 and an injector 42.

Each port of the array has a terminus 44 in the lower portion 28, a diameter E and extends horizontally away from the terminus 44 such that the working fluid is directed towards a center of the conduit (not shown). The total number of ports 40 is N2.

The injector 42, which is disposed at the junction of the intermediate portion 32 and the bridging portion 34, has an annular terminus having a radial thickness B, and extends vertically downwardly a distance A such that the working fluid is directed vertically upwardly.

An annular chamber 46 surrounds the injector 42 and communicates therewith through a row of apertures 48, each having a diameter. The row of apertures 48 is spaced a distance F from the junction of the transition portion 30 and the intermediate portion 32. The total number of apertures 48 is N1.

More particularly, D, A, B, C, d, E, F, N1 and N2 can be according to any of the geometries set out in Table 1

| Geometry | D mm | A mm | B mm | C mm | d mm | E mm | F mm | N1 | N2 |
|---|---|---|---|---|---|---|---|---|---|
| 1 | 25.4 | 20.3 | 1.5 | 15.2 | 15.2 | 1.5 | 6.35 | 12 | 108 |
| 2 | 50.8 | 22.1 | 1.5 | 38.1 | 38.1 | 1.5 | 8.13 | 12 | 378 |
| 3 | 101 | 68.1 | 2 | 90.2 | 90.2 | 2 | 34.0 | 10 | 038 |
| 4 | 152 | 101 | 2 | 147 | 147 | 2 | 44.5 | 15 | 1480 |
| 5 | 203 | 142 | 3 | 12.7 | 194 | 3 | 61.2 | 14 | 1280 |

Table 1

Figure 3:
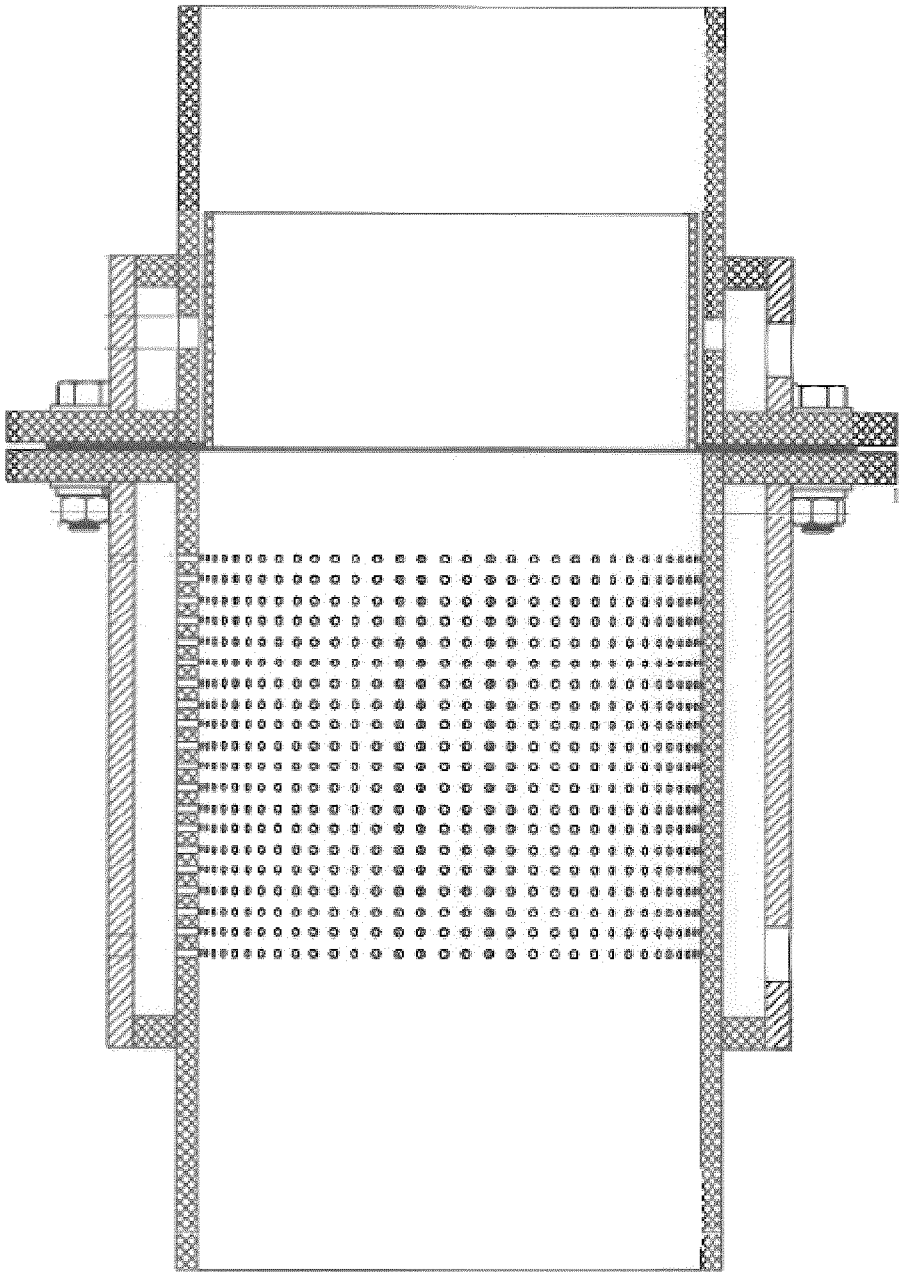
FIG. 3 is a cross-section of a pump constructed according to another exemplary embodiment of the invention.

The pump shown in FIG. 1 and FIG. 2 will be understood to be readily constructed by three dimensional printing using conventional processes. However, this is not required and the pump can also readily be constructed by conventional machining, as shown in FIG. 3.

Five versions of the pump of the present invention were constructed, in accordance with each of the geometries.

These five pumps were tested, the results being set out in Table 2 below:

| | Low operating | | High Operating | | | | | Power required (W) | |
|---|---|---|---|---|---|---|---|---|---|
| Pump Geometry | Total air flow rate $m^3/s$ | Water flow Rate $m^3/s$ | Total air flow rate $m^3/s$ | Water Flow Rate $m^3/s$ | Submergence ratio | Submergence head(m) | Required pressure (kPa) | Low operating range | High operating range |
| 1 | .00023 | .0004 | .0006 | .00062 | .9 | 1.41 | 13.2 | 3.78 | 9.86 |
| 1 | .00027 | .0002 | .0008 | .0004 | .5 | .78 | 3.74 | 1.3 | 3.84 |
| 2 | .0002 | .0007 | .0027 | .0021 | .9 | 1.41 | 13.17 | 3.28 | 44.27 |
| 2 | .0018 | .0005 | .004 | .0007 | .5 | .78 | 3.74 | 8.65 | 19.23 |
| 3 | .00115 | .0037 | .013 | .0103 | .9 | 1.41 | 13..17 | 18.86 | 213.15 |
| 3 | .01 | .0025 | .023 | .0036 | .5 | .078 | 3.74 | 48.04 | 110.50 |
| 4 | .006 | .017 | .02 | .026 | .9 | 1.41 | 13.16 | 98.32 | 327.74 |
| 4 | .025 | .006 | .06 | .009 | .5 | .78 | 3.73 | 119.86 | 287.67 |
| 5 | .007 | .015 | .02 | .043 | .9 | 1.41 | 13.15 | 114.62 | 327.49 |
| 5 | .05 | .011 | .08 | .016 | .5 | .78 | 3.71 | 238.65 | 381.85 |

Table 2

A further annular chamber 50 surrounds the lower portion 28 and communicates with ports 40. Persons of ordinary skill will readily appreciate that, in use, gas such as air is introduced into chambers 46, 50, and thereby into the fluidic material via lifting arrangement 24.

As one characteristic of the pump, if B, C, D, E and F are expressed in millimetres:

D is between about 25.4 and 203.2

$B \approx 0.521(D)^{0.296}$ $C \approx 1.918(D)^{0.343}$ $E \approx 0.521(D)^{0.296}$ $F \approx 0.321D - 3.41$ For greater certainty, in Table 2, "submergence ratio" is the ratio between the portion of the riser that is filled by liquid to the total pipe length and the "submergence head" is portion of the pipe filled with liquid. Persons of ordinary skill will readily perceive that the pumps are capable of pumping relatively large volumes of water relatively efficiently.

Figure 4:
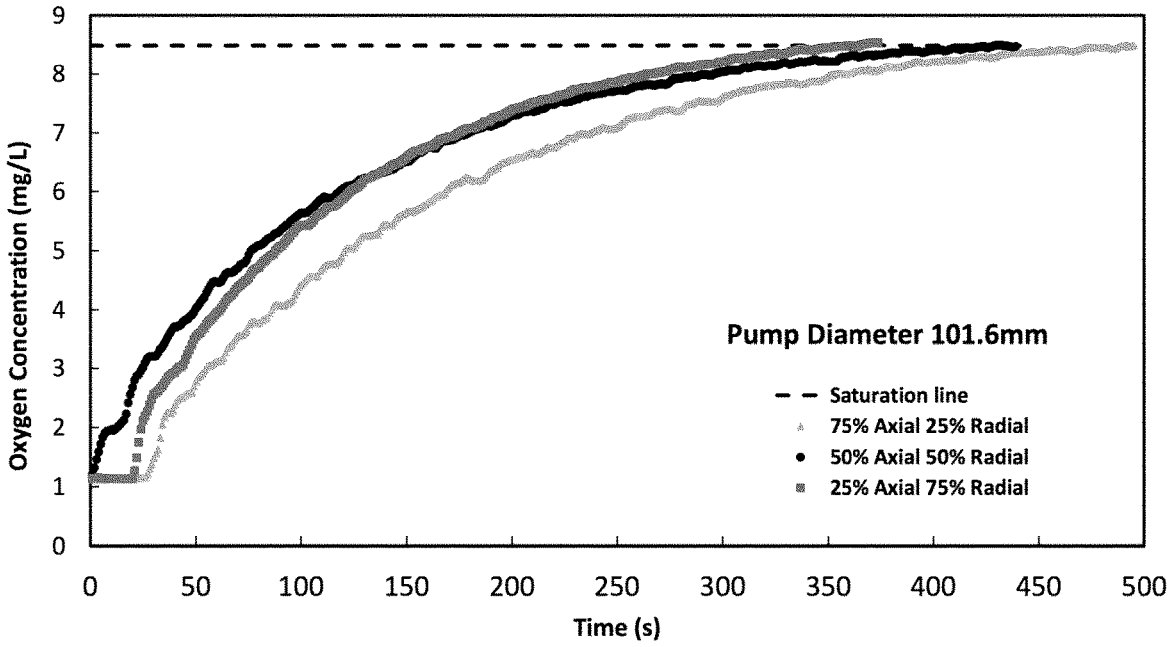
FIG. 4 shows the aeration performance for a pump according to an embodiment of the invention.

The 101.6 mm pump was tested for aeration performance, as shown in FIG. 4. The test involved pumping water in a tank on a recirculating basis. Three tests were conducted. In each test, the water in the tank was exposed to atmosphere for a sufficient time to allow oxygen concentration to equilibrate at 1 mg/L. A constant volumetric flow of gas was forced through the pump in each test. In the first test, 75% of the flow was directed through the lower array and 25% through the upper; in the second test, the flow was split 50:50; and in the third test, 25% of the flow was directed through the lower array and 75% through the upper. FIG. 4 shows that by forcing more flow through the lower array, oxygenation is increased.

Figure 5:
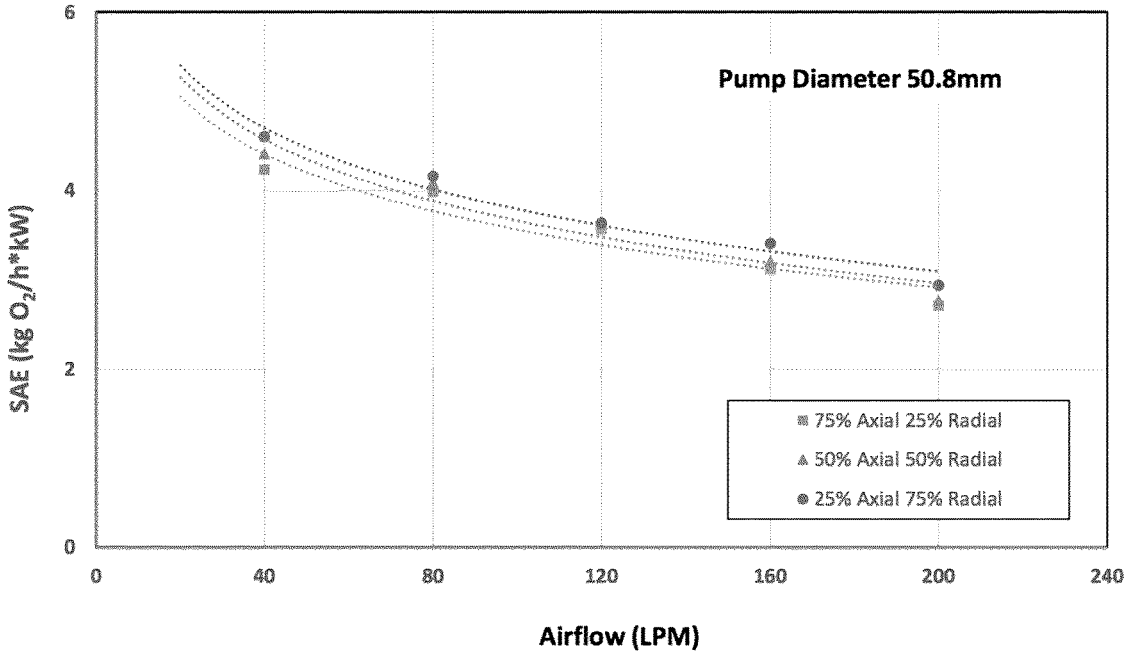
FIG. 5 shows the aeration performance for a pump according to another embodiment of the invention.

The 50.8 mm pump was tested for Standard Aeration Efficiency as shown in FIG. 5. Again, three tests were carried out, each involving pumping water in a tank on a recirculating basis. In each test, the water in the tank was exposed to atmosphere for a sufficient time to allow oxygen concentration to equilibrate at 1 mg/L. A constant volumetric flow of gas was forced through the pump in each test. In the first test, 75% of the flow was directed through the lower array and 25% through the upper; in the second test, the flow was split 50:50; and in the third test, 25% of the flow was directed through the lower array and 75% through the upper. FIG. 5 shows that the amount of oxygen transferred to the water for each kW used in the air blower is highest for the 75% radial flow test; the amount of oxygen transferred to the water decreased over time as the water reaches saturation.

Accordingly, the invention should be understood to be limited only by the accompanying claims, purposively construed.

The invention claimed is:

1. A pump for use with a supply of working fluid and a supply of fluidic material having a density higher than that of the working fluid, the pump comprising:

a vertically-extending conduit that, in use, is immersed in the supply of fluidic material, the vertically-extending conduit having a lower portion, an upper portion and an intermediate portion between the lower and upper portions, the intermediate portion having a cross-sectional area smaller than that of the upper portions, the lower portion having a diameter D and the intermediate portion having a diameter d a lift arrangement including:

an array containing N2 number of ports arranged over a length of the lower portion, each port of the array having a diameter E, further having a terminus at the lower portion and extending horizontally away from the terminus such that the working fluid is directed towards a center of the conduit;

an injector having a terminus at the top of the intermediate portion and extending vertically downwardly such that the working fluid is directed vertically upwardly, the terminus of the injector being defined by a cylindrical groove having a thickness B; and an annular chamber surrounding the injector, having a length A and communicating with the injector through a row containing N1 number of apertures spaced a distance F from the junction of the transition portion and the intermediate portion and each having a diameter C;

wherein when B, C, D, E and F are expressed in millimeters (mm):

D is substantially between 25.4 mm and 203.2 mm,

B is substantially equal to $0.521(D)^{0.296}$,

C is substantially equal to $1.918(D)^{0.343}$,

E is substantially equal to $0.521(D)^{0.296}$, and

F is substantially equal to 0.321D−3.41.

2. The pump according to claim 1, wherein D, A, B, C, d, E, F, N1 and N2 are sized according to any of the following geometries:

| Geometry | D mm | A mm | B mm | C mm | d mm | E mm | F mm | N1 | N2 |
|---|---|---|---|---|---|---|---|---|---|
| 1 | 25.4 | 20.32 | 1.5 | 15.24 | 15.24 | 1.5 | 6.35 | 12 | 108 |
| 2 | 50.8 | 22.098 | 1.5 | 38.1 | 38.1 | 1.5 | 8.128 | 12 | 378 |
| 3 | 101.6 | 68.072 | 2 | 90.2 | 90.2 | 2 | 34.036 | 10 | 038 |
| 4 | 152.4 | 101.6 | 2 | 147.1 | 147.1 | 2 | 44.45 | 15 | 1480 |
| 5 | 203.2 | 142.21 | 3 | 12.7 | 194.2 | 3 | 61.15 | 14 | 1280. |

3. Use of the pump according to claim 2 with air as the working fluid and water as the fluidic material.

4. Use of the pump according to claim 3, wherein the combination of air flow, water flow and geometry fall substantially in accordance with any of the following combinations:

| Combination | Air Flow (cubic meters per second) | Water Flow (cubic meters per second) |
|---|---|---|
| 1 | .00023-.00027 | .0002-.004 |
| 2 | .0002-.0018 | .0005-.0007 |
| 3 | .00115-.01 | .0025-.0037 |
| 4 | .006-.025 | .006-.017 |
| 5 | .008-.05 | .011-.015. |

* * * * *